United States Patent [19]

Sheard et al.

[11] 4,195,112

[45] Mar. 25, 1980

[54] PROCESS FOR MOLDING A NON-WOVEN FABRIC

[75] Inventors: Dennis R. Sheard; Roger W. Taylor, both of Harrogate, England

[73] Assignee: Imperial Chemical Industries Limited, London, United Kingdom

[21] Appl. No.: 880,304

[22] Filed: Feb. 22, 1978

[30] Foreign Application Priority Data

Mar. 3, 1977 [GB] United Kingdom ..... 9016/77

[51] Int. Cl.[2] ..... B27J 5/00; D04H 1/58

[52] U.S. Cl. ..... 428/288; 264/119; 264/122; 264/126; 428/296

[58] Field of Search ..... 264/122, 126, 119; 428/198, 288, 296, 373

[56] References Cited

U.S. PATENT DOCUMENTS

| | | | |
|---|---|---|---|
| 2,773,286 | 12/1956 | Piccard et al. | 264/122 |
| 3,229,008 | 1/1966 | Harrington, Jr. et al. | 264/122 |
| 3,452,128 | 6/1969 | Rains | 264/122 |
| 3,898,311 | 8/1975 | Mitchell et al. | 264/122 |
| 3,989,788 | 11/1976 | Estes, Jr. et al. | 264/122 |

*Primary Examiner*—Robert F. White
*Assistant Examiner*—James R. Hall
*Attorney, Agent, or Firm*—Cushman, Darby & Cushman

[57] ABSTRACT

A process for molding a coherent, pliable, thermally bonded, non-woven fabric comprising potentially adhesive fibers wherein the fabric is molded and new or stronger thermal bonds are developed within the fabric by the application of heat, whereby the cooled fabric retains its molded shape.

8 Claims, No Drawings

PROCESS FOR MOLDING A NON-WOVEN FABRIC

The present invention relates to a process for molding a non-woven farbic.

According to the present invention there is provided a process for molding a coherent, pliable, thermally bonded, non-woven fabric comprising at least 20% potentially adhesive fibers (as hereinafter defined) wherein the fabric is formed into a desired shape and is subjected to a process to increase the degree of thermal bonding to a level sufficient to cause the fabric to retain its desired shape.

The fabric to be molded may be a single fabric, or it may be part of a fabric assembly formed by stitching or similarly bonding two or more fabrics together. The fabrics may be formed from continuous filaments or staple fibers, and consequently the term fiber used throughout this specification is meant to include both of these alternatives. At least 20% of the fibers are of the potentially adhesive type, by which term it is meant that the fibers comprise at least two fiber forming, polymeric components extending along the length of the fiber, one of the components having a lower softening temperature than the other component(s) and forming at least part of the peripheral surface of the fiber. The components of the fiber may be arranged in a side-by-side configuration in which case the component having the lower softening temperature preferably forms 40 to 60% by weight of the fiber cross-section. Desirably the components are arranged in a sheath/core configuration, the sheath, which is formed of the lower softening component, preferably comprising 10 to 35%, desirably 20 to 33%, of the fiber cross-section. Preferably the fabric comprises at least 50%, and desirably is formed entirely of, potentially adhesive fibers. Potentially adhesive fibers formed from polyolefines, polyamides, and polyesters, especially polyethylene terephthalate and its co-polymers, are particularly advantageous.

Fabrics suitable for molding by the process of the present invention contain a number of fibers which are thermally bonded one to another. The thermal bonds may be present in discrete areas located throughout the fabric, but separated from each other by areas in which thermal bonds are absent. Fabrics having such a distribution of thermal bonds are frequently known as "point bonded fabrics." Alternatively, the fabrics may have thermal bonds distributed throughout the fabric, and such fabrics are often known as "area bonded fabrics". The degree of thermal bonding present in such fabrics must not be excessive, otherwise the fabric will not be pliable and it will be difficult to form the fabrics into a desired shape. On the other hand, the degree of thermal bonding must provide sufficient cohesion of the fibers so that the fabric can be readily handled. The thermal bonds may be produced by any convenient means. For example the thermal bonds may be produced by passing a heated fluid, optionally capable of plasticising the fibers, through the fabric or by passing the fabric between a pair of heated rolls. The rolls may have raised portions, the raised portions of one roll co-operating with the raised portions of the other roll, so that fabrics passed between the rolls are thermally bonded in discrete areas. The fabrics may also be bonded by ultrasonic vibrations, the fabrics being passed through a gap formed by an ultrasonic work horn and an anvil. The anvil may be in the form of a roll having raised portions to give a point bonded fabric.

Forming the fabric into a desired shape may be by any convenient means. Thus, the fabric may be wrapped around the outside or inside of a mold. Shaping the fabric between male and female molds is particularly convenient. The shaping may be performed continuously, for example by passing the fabric between co-operating rolls having projections thereon to give the required shape.

The fabric, either during or after the shaping stage, is subjected to a process which increases the degree of thermal bonding. The degree of thermal bonding may be increased by forming new bonds, or by increasing the strength of the bonds originally present. The latter may be achieved simply by heating the fabric at the bond points to a temperature above that used for the original bonding step. Where the fabric is a point bonded fabric, additional bonds may be produced in those regions of the fabric in which thermal bonding is absent. However, in the case of area bonded fabrics in which substantially all the fibers are bonded at their points of contact with other fibers, to produce additional bonds it is necessary to subject the shaped fabric to a distorting force in order to provide additional points of fiber/fiber contact before commencement of the thermal bonding step. The distorting force may be produced by the shaping operation itself, or by a separate operation such as, for example, by compressing the fabric. The additional thermal bonds in the fabric may be produced by the application of heat, such as, for instance, by the passage of a heated fluid through the fabric or by direct contact with heated surfaces, or by subjecting the shaped fabric to ultrasonic vibrations. The number of additional thermal bonds produced must be sufficient to cause the shaped fabric to retain its shape after being removed from the mold, and, where thermal bonding is by the application of direct heat, the fabric is allowed to cool.

By controlling the step during which the degree of thermal bonding is increased, it is possible to produce a range of shaped products, ranging from flexible to rigid products. Thus, in the case where the increase in degree of thermal bonding is produced by the application of direct heat, the degree of stiffness of the resultant shaped product will be affected by the temperature to which the fabric is heated, the time of heating, and the extent of distortion (eg compression) during heating.

Products produced by the process of the present invention have a wide range of uses, especially in the domestic and industrial fields. Products that may be made by the process include garments or parts of garments, lamp shades, covers for furniture and machinery, and filters. The process of the present invention is particularly applicable for the production of shaped products having controlled porosity or working properties.

The invention will be further described with reference to the following examples.

EXAMPLE 1

Two brass plates each having a length of 150 mm, a width of 120 mm, and a thickness of 8 mm were milled to provide male and female parts of a mold. The pattern of the mold comprised 4 mm rectangular indentations running parallel to the shorter side, and having a depth of 2 mm, a width of 4 mm and a spacing of 20 mm. A fabric thickness of 0.3 mm was allowed for. A sheet of point bonded melded fabric formed entirely from potentially adhesive conjugate sheath/core polyester fibers and having a pebble surface configuration and an area density of 160 g/m$^2$ was molded using the above apparatus. The core of the fibers was formed of poly(ethylene terephthalate) and the sheath of poly(ethylene terephthalate-isophthalate) 85:15 mole percent copolymer. The fabric was placed between the male and female portions of the mold and the plates were subjected to a pressure of 250 psi in a heated press at 210° C. for 5 minutes. On removal from the mold and cooling, the fabric was rigid and the bonded portions could withstand a pressure of 1 kg/cm$^2$ without appreciable deformation.

EXAMPLE 2

Two pieces of point bonded melded polyester fabric of 150 g/m$^2$ weight formed entirely of potentially adhesive sheath/core conjugate polyester fibers (as described in Example 1) and having a pebble surface configuration were sewn together along two lines spaced 13 mm apart, and a brass tube of 7.5 mm external diameter was inserted into the slot. The assembly was suspended in a hot air oven at 210° C. for 4 minutes. The fabric was removed from the oven and cooled to give a rigid tube which could withstand a pressure of 200 g/linear cm without appreciable deformation.

EXAMPLE 3

Experiment 2 was repeated, except that the stitching was replaced by sealing, using a polythene bag sealer operating at maximum time and temperature. The heat seal remained intact during the heating stage and a rigid tube was produced as above.

EXAMPLE 4

A sample of non-woven fabric sold under the trade name CAMBRELLE (registered in the name of Imperial Chemical Industries Limited, London, England) of width 320 mm, nominal weight 150 g/m$^2$ and thickness 0.7 mm comprising conjugate fibers having a core of polyethylene terephthalate and a sheath of a copolymer of polyethylene isophthalate and polyethylene terephthalate (15/85 mole ratio) was passed between two calender rolls of width 320 mm and diameter 133 mm. The rolls were machined in manufacture so that splines of approximately triangular cross section and height 0.8 mm meshed with grooves in the other roll of similar cross section having a depth of 0.8 mm. The surface temperature of both rolls was 195° C. and the hydraulic pressure applied was 40 psi. The fabric passed between the rolls at a speed of 6 meters per minute. On cooling , the resultant shaped fibrous structure was a sheet material of greater stiffness than the original fabric with projecting ribs in parallel arrays separated by a distance of 12 mm. The means thickness of the sheet material between the ribs was 0.25 mm and the mean overall thickness of the sheet at the ribs was 0.75 mm.

EXAMPLE 5

A sample of CAMBRELLE (RTM) fabric of width 320 mm, nominal weight 140 g/m$^2$ and thickness 0.9 mm comprising conjugate fibers having a core of polypropylene and a sheath of polyethylene was passed between the calender rolls described in example 4 at a speed of 6 meters per minute. The surface temperature of the splined roll was 125° C. and that of the grooved roll was 115° C. The applied pressure was 40 psi. On cooling, the resultant structure had mean thickness 0.33 mm between the ribs and 1.02 mm at the ribs.

EXAMPLE 6

A sample of CAMBRELLE (RTM) fabric of width 320 mm, nominal weight 150 g/m$^2$ and thickness 0.9 mm comprising conjugate fibers having a core of Nylon 6.6 and a sheath of Nylon 6 was passed between the calender rolls described in example 4 at a speed of 6 meters per minute. The surface temperature of the splined roll was 190° C. and that of the grooved roll 185° C. The applied pressure was 40 psi. On cooling, the resultant structure had means thickness 0.28 mm between the ribs and 0.87 mm at the ribs.

We claim:

1. A process for molding a shaped article from an initial coherent, pliable, non-woven fabric comprising at least 20% of potentially adhesive fibers which have been formed from at least two fiber-forming polymeric components selected from the group consisting of polyolefines, polyamides, and polyesters, the components extending along the length of the fiber and one of the components having a lower softening temperature than the other components and forming at least part of the peripheral surface of the fiber, the fabric having discrete areas (A) in which fibers have been thermally bonded one to another, and discrete areas (B) in which thermally bonded fibers are absent, the molding process comprising the steps of (a) shaping the fabric by pressing it against the surface of a mold, (b) heating the shaped fabric while retained on the mold to a temperature at least equal to the softening temperature of the lower softening component but below the softening temperature of the other components of the potentially adhesive fibers to cause bonding of the potentially adhesive fibers in the discrete areas (B), (c) cooling the fabric, wherein the time and temperature of the heating of step (b) produce a level of fiber bonding sufficient to cause the cooled fabric to retain its molded shape and (d) removing the resulting shaped article from the mold.

2. A process for molding a shaped article from an initial coherent, pliable, non-woven fabric which comprises at least 20% of potentially adhesive fibers which have been formed from at least two fiber-forming polymeric components selected from the group consisting of polyolefines, polyamides and polyesters, the components extending along the length of the fiber and one of the components having a lower softening temperature than the other components and forming at least part of the peripheral surface of the fiber and the fabric having throughout its area fibers thermally bonded one to another, the process comprising the steps of (a) shaping the fabric by compressing and distorting it against the surface of a mold, (b) heating the shaped fabric while retained on the mold to a temperature at least equal to the softening temperature of the lower softening component but below the softening temperature of the other components of the potentially adhesive fibers to cause bonding of the potentially adhesive fibers to a level greater than that present in the initial fabric, (c) cooling the fabric, wherein the degree of compression and the time and temperature of the heating of step (b) produce a level of fiber bonding sufficient to cause the cooled fabric to retain its molded shape and (d) removing the resulting shaped article from the mold.

3. A process for molding a shaped article from an initial coherent, pliable, thermally bonded, non-woven fabric comprising at least 20% of potentially adhesive fibers which have been formed from at least two fiber-forming polymeric components selected from the group consisting of polyolefines, polyamides, and polyesters, the components extending along the length of the fiber and one of the components having a lower softening temperature than the other components and forming at least part of the peripheral surface of the fiber, the process comprising the steps of (a) shaping the fabric by pressing it against the surface of a mold, (b) heating the shaped fabric while retained on the mold to a temperature at least equal to the softening temperature of the lower softening component but below the softening temperature of the other components of the potentially adhesive fibers to cause bonding of the potentially adhesive fibers to a level greater than that present in the initial fabric, (c) cooling the fabric, wherein the time and temperature of the heating of step (b) produce a level of fiber bonding sufficient to cause the cooled fabric to retain its molded shape and (d) removing the resulting shaped article from the mold.

4. A process according to claim 1, claim 2 or claim 3 wherein the process is continuous and the mold used in step (a) comprises a shaped roll.

5. A process according to claim 3 wherein the shaped fabric is heated in step (b) to a temperature greater than the temperature used for producing the initial coherent, pliable, thermally bonded, non-woven fabric.

6. A molded, thermally bonded, non-woven fabric produced by the process of claim 1.

7. A molded, thermally bonded, non-woven fabric produced by the process of claim 2.

8. A molded, thermally bonded, non-woven fabric produced by the process of claim 3.

* * * * *